US005664696A

United States Patent [19]

Canga

[11] Patent Number: 5,664,696

[45] Date of Patent: Sep. 9, 1997

[54] INSTALLATION OF TANKS FOR STORING FUEL OR CHEMICAL PRODUCTS IN SERVICE STATIONS AND THE LIKE

[76] Inventor: Jose Luis Martinez Canga, Diaz Velez 5110, (1405) Buenos Aires, Argentina

[21] Appl. No.: 429,275

[22] Filed: Apr. 25, 1995

[30] Foreign Application Priority Data

May 6, 1994 [AR] Argentina ..... 328.148

[51] Int. Cl.[6] ..... B65D 90/00

[52] U.S. Cl. ..... 220/4.12; 220/445; 220/23.4

[58] Field of Search ..... 220/448, 4.12, 220/23.4, 4.15, 4.14, 23.86, 23.2

[56] References Cited

U.S. PATENT DOCUMENTS

| | | | |
|---|---|---|---|
| 4,374,478 | 2/1983 | Secord et al. | 220/445 |
| 5,082,138 | 1/1992 | McGarvey | 220/445 |
| 5,285,914 | 2/1994 | Del Zotto | 220/4.12 |
| 5,299,709 | 4/1994 | Beerbower et al. | 220/445 |

*Primary Examiner*—Joseph M. Moy

*Attorney, Agent, or Firm*—Keck, Mahin & Cate

[57] ABSTRACT

A battery of reservoirs for storing fuel, gas, contaminants and/or fluids, including external means for structurally protecting the tanks and providing stability to protect the surrounding environment from fluid leaks. The external means comprise a plurality of two-tiered containers, each sealed off below and all around its sides by a wall the inner surface of which is covered by a membrane of a impermeable and chemically resistent material. A concrete lid seals each tank and has at least one orifice communicating with the load inlet of the corresponding tank. The walls of the container have at least one orifice through which a respective pipe passes for dispensing fuel and means for coupling slings for hoisting and lowering the container. Such coupling means are later used for attaching deadweights after installation. The tank inside the container is substantially spaced underneath and at its sides from said membrane by binder material which fills the space between the tank and the container up to a level which at least practically covers the tank. Moreover, the height of the container may be selected by varying the height of the wall of said upper stage. Methods for building and installing the battery specified above and replacing a tank are also disclosed.

14 Claims, 2 Drawing Sheets

INSTALLATION OF TANKS FOR STORING FUEL OR CHEMICAL PRODUCTS IN SERVICE STATIONS AND THE LIKE

FIELD OF THE INVENTION

The instant invention relates to storage of chemical and petrochemical products, more particularly fuel or gasoline in reservoirs such as, but not limited exclusively to, those installed in service stations and gas dispensing premises. In particular, although not exclusively, the invention is related to tank reservoirs, either underground or above-level. Still more particularly, it is related to a novel construction system for fuel tank reservoirs and to a novel method for the construction of the reservoirs and installation and replacement of the tanks.

The present invention is disclosed herein by reference to storage of oil, fuel, petrol or gasoline (i.e. "gas"), without prejudice to its application in other fields under similar circumstances, such as depots for other chemical and petrochemical products.

BACKGROUND OF THE INVENTION

Most service stations store fuel or gas in reservoirs made up by various underground tanks made of metal or fiberglass, able to store many thousands of liters. Such tanks are buried in binder material and/or earth or sand and are connected to ventilation and loading orifices, placed usually in the floor of the station and by piping to the fuel pumps.

The presence of buried tanks on the site gives rise to actual and potential problems which should be addressed for proper installation. One such problem is tank protection itself, since the tanks are physically and chemically exposed to the surrounding environment which tends to rust them and subject them to mechanical stresses which may end up by either of them eventually rupturing or desintegrating. Another problem is the reverse of the previous one, that is the danger resulting from loss of integrity of the installation leading to progressive or massive fuel or gas leaks causing a direct impact on the environment and mortal risk to people.

SUMMARY OF THE PRIOR ART

The double-wall system is the most reliable used heretofore. It uses double-walled tanks, i.e. comprising an internal metallic wall and an outer wall of plastics and/or metal too, layed on binder beds and connected to the gas pumps via double-walled pipes, which may be flexible and/or rigid and to the ventilation and loading orifices via respectively single and double-walled rigid pipes.

Various drawbacks have been found in this system. For example, the use of anchorage means to avoid underground tank flotation is not reliable, since small anchorage shift may lead to vertical tank shifts which, however small, may rupture the rigid piping.

In said system, as in other known ones, deterioration of the external plastics wall, which may fissure or else become unstuck, means that the whole tank has to be taken out, for which it is not only necessary to have the required labour and machinery available but also upset everyday operations on the premises for a considerable time. Moreover, such deteriorated and contaminated tanks cannot be recycled, so that it is necessary to get rid of the useless unit, which in practice may cost as much as the purchase and installation of a new tank.

The problem of taking out a tank from its underground bed further damages the installation, because removal of the binder material pressed underground disturbs this material and disaccomodates the neighbouring tanks. Therefore, if one tank of the reservoir has to be removed, it is previously necessary to drive in piles to hold the other tanks in place and avoid them moving about.

SUMMARY OF THE INVENTION

Consequently, the present invention suggets a novel construction for a battery of containers which pursues a series of operational, commercial and environment-related objects.

One of such objets is to enable contaminated tanks to be recycled, repaired and able to be checked by the authorities. Use of recycled tanks checks further environment contamination from steel works, as happens heretofore when old tanks are substituted by new metal units. It also reduces expenses due to dismantling old tanks and minimizes discarding of contaminated material to what is strictly unavoidable.

Another of the objects of the invention is to arrange for the installation to be permanently and integrally monitored, wherein the entire row of tanks may be exposed to visual checks for fuel leaks, environment protection and assist the authorities in checking and auditing the installation.

Yet another object of the invention is to fully isolate the surrounding terrain, if it is contaminated, from the tanks to be installed, as well as to protect the tanks from subterranean water streams and other earth agents which may shorten the useful lifeterm of the tank.

Yet another object of the invention is to enable full recovery of the premises with good earth in the event the service station closes down and the installation is removed elsewhere.

A further object is to have the battery of the invention fully isolated should the earth therearound become very contaminated and require chemical treatment.

It is also an object of the invention to be able to install the battery using everyday labour and machinery, as well as to reduce installation time by about two-thirds in relation to prior art systems, and extending these advantages to tank exchange operations. Moreover, this object bears in mind the possibility of carrying out a unitary tank replacement without greatly disturbing normal service station work.

Another object of this invention is to reduce the size of the premises required for a battery of reservoirs, that is, to reduce the floor occupation factor (FOF).

An aditional object is a universal battery system which may be easily and simply adapted to random terrain distributions of any service station.

Another aditional object is to replace the current anchorage system by more reliable means.

Yet another object is to be able to carry out modifications in the battery, such as relocating the loading orifice or to implement new technologies, for example for recovering vapours, without having to break the floor of the station or the piping.

Yet another object of the invention is to develop a universal construction suitable both for underground and above-level reservoirs.

The present invention realizes the above and other objects by means of a battery of reservoirs for storing fuel, gas, contaminants and/or fluids in general, of the type comprising tanks suitable for containing hydrocarbon and chemical products including external means for structurally protecting the tanks and providing stability to protect the surrounding environment from fluid leaks. The external means comprise a plurality of containers, preferably aligned forming modules beside one another underground, each constructed to self support its weight and to contain a tank. Each container is sealed off below and all around its sides by a wall the inner surface of which is substantially covered by a membrane of a material impermeable and resistent to hydro-carbons and/or chemical contaminating products. A lid seals this tank and is made of a concrete slab having at least one orifice communicating with the load inlet of the corresponding tank. The concrete slab eventually may become part of the floor of the service station. The walls of the container have at least one orifice through which a respective pipe passes for dispensing fuel and means for coupling slings for hoisting and lowering the container. Such coupling means may also be used for attaching deadweights after installation, in place of the conventional, but not always safe, anchorage devices. The tank inside the container is substantially spaced underneath and at its sides from said membrane by binder material which fills the space between the tank and the container up to a level which at least practically covers the tank.

According to a particular aspect of the invention, each container comprises two construction stages: a lower stage which includes a floor or bottom and part of the sides and ends extending up to a level approximately that of the height of the tank, and an upper stage which rests on the bottom stage and which, in turn, supports the lid of the container. Moreover, the height of the container may be selected by varying the height of the wall of said upper stage.

The battery is conveniently provided with sensors for monitoring leakages of contaminant chemical or fuel fluids. Such leakages may eventually be aspired and ventilated by piping arranged for this purpose.

The present invention also comprises a novel method for building the battery specified above and which comprises the following steps: lowering the lower stage of the container by means of a crane into an excavation, lay a bed of filler material on the floor of the container, lower the tank inside the lower stage with the crane and rest it on the bed, place the leakage sensors and eventually the piping for aspirating leaked fluids from the bed, fill in more filler material up to the body of the tank, lower the second stage with the crane and rest it on the wall of the first stage, pass the discharge piping through the orifices in the upper stage and hermetically seal the nooks between the piping and the orifice, install remote loading means and join them to the tank and installing the ventilation means, and place the lid over the second stage.

In the preferred manner of carrying out the method, the initial step comprises lowering a plurality of bottom stages and placing them beside one another.

In addition to the relative ease of the installation process just specified, the constructive principle of the invention simplifies the procedure for replacing a tank of the battery, by means of the following steps: lifting the lid off the container, removing the binder material covering the tank, disconnecting the discharge piping joints, operating a crane to lift the old tank, lower the new tank by means of the crane into said lower stage until it rests on said bed, replace the binder material up to the body of the tank, reconnect said joints, and replace the lid over said second stage.

BRIEF DESCRIPTION OF THE DRAWINGS

The above-stated and other novel features and aspects of this invention and its reduction to practice are brought out by the following detailed description of a preferred embodiment shown by way of example in the attached drawings, wherein.

DETAILED DESCRIPTION OF A PREFERRED EMBODIMENT

Figure 1:
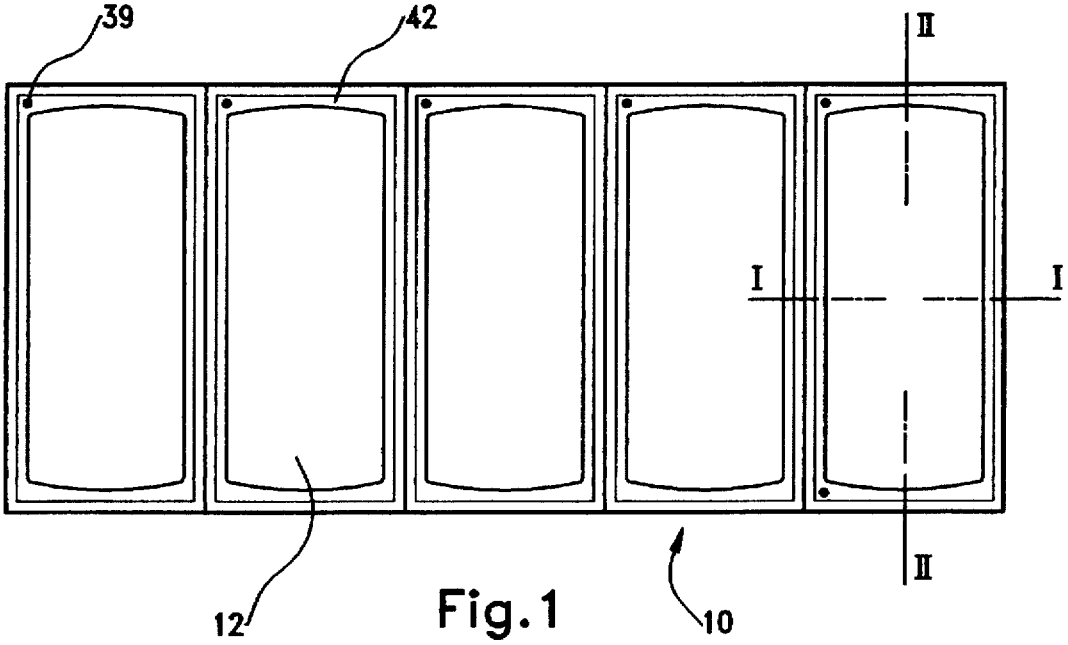
FIG. 1 is a plan view of a battery of fuel reservoirs according to the present invention.
Figure 2A:
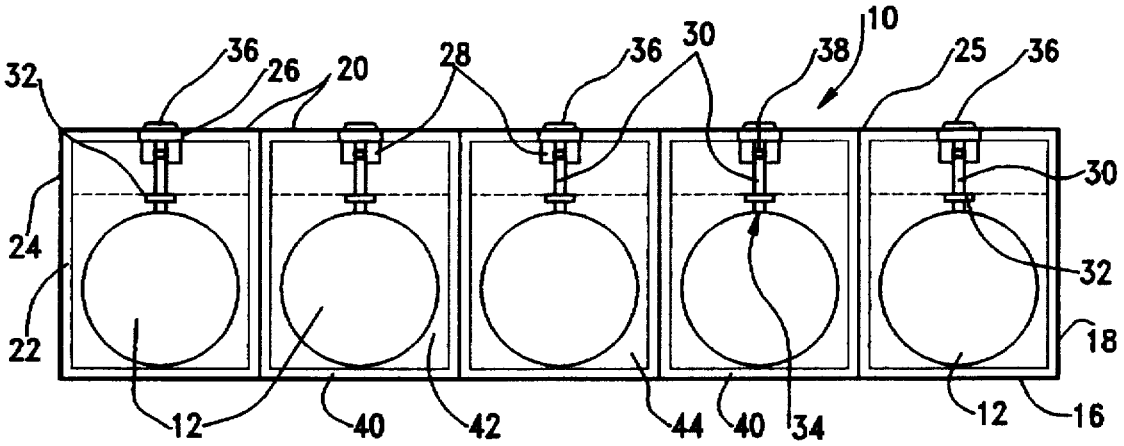
FIGS. 2A and 2B are section views of the battery according to planes I—I and II—II, respectively, of FIG. 1.

FIGS. 1 and 2A show a battery 10 according to the invention comprising a plurality of tanks 12 suitable for storing hydrocarbon products in the interior thereof. Although a battery 10 of five tanks 12 is shown, it is obvious that it may comprise a different number, from just one tank 12 up to a maximum depending on the size of the premises.

The tanks 12 may be metallic or of fibre-glass and each is arranged inside a module comprising an individual container 14, each container comprising a sealed outer housing having a bottom 16, side and end walls 18 and a flagstone lid 20, all constructed of premoulded concrete. More particularly, the vertical walls 18 of the container 14 are assembled in two parts, that is a lower stage 22 comprising the bottom 16 and a part of the walls 18 up to a height approximately that of the tank 12 and an upper stage 24 comprising the upper part of the four walls 18 and on which the lid 20 rests. The preferred dimensions of the containers 14 are about 20 feet long, 8.5 feet wide and 11.5 feet high; of this latter dimension at least 8 feet correspond to the lower stage 22 and 3 feet, or more depending on the legal framework, to the upper stage 24. According to one aspect of the invention, the upper stage 24 may be embodied by concrete structures of varying height according to the depth of the excavation hole in relation to the floor-level of the service station.

The modules 14 of the battery 10 are aligned one beside the other inside the dug-out hole, the adjacent lids being sealed by means of a cement joint 25.

Figure 2B:
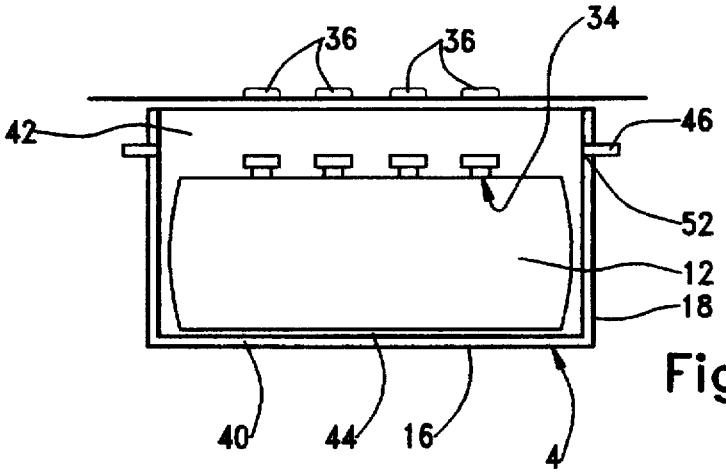
Figure 3:
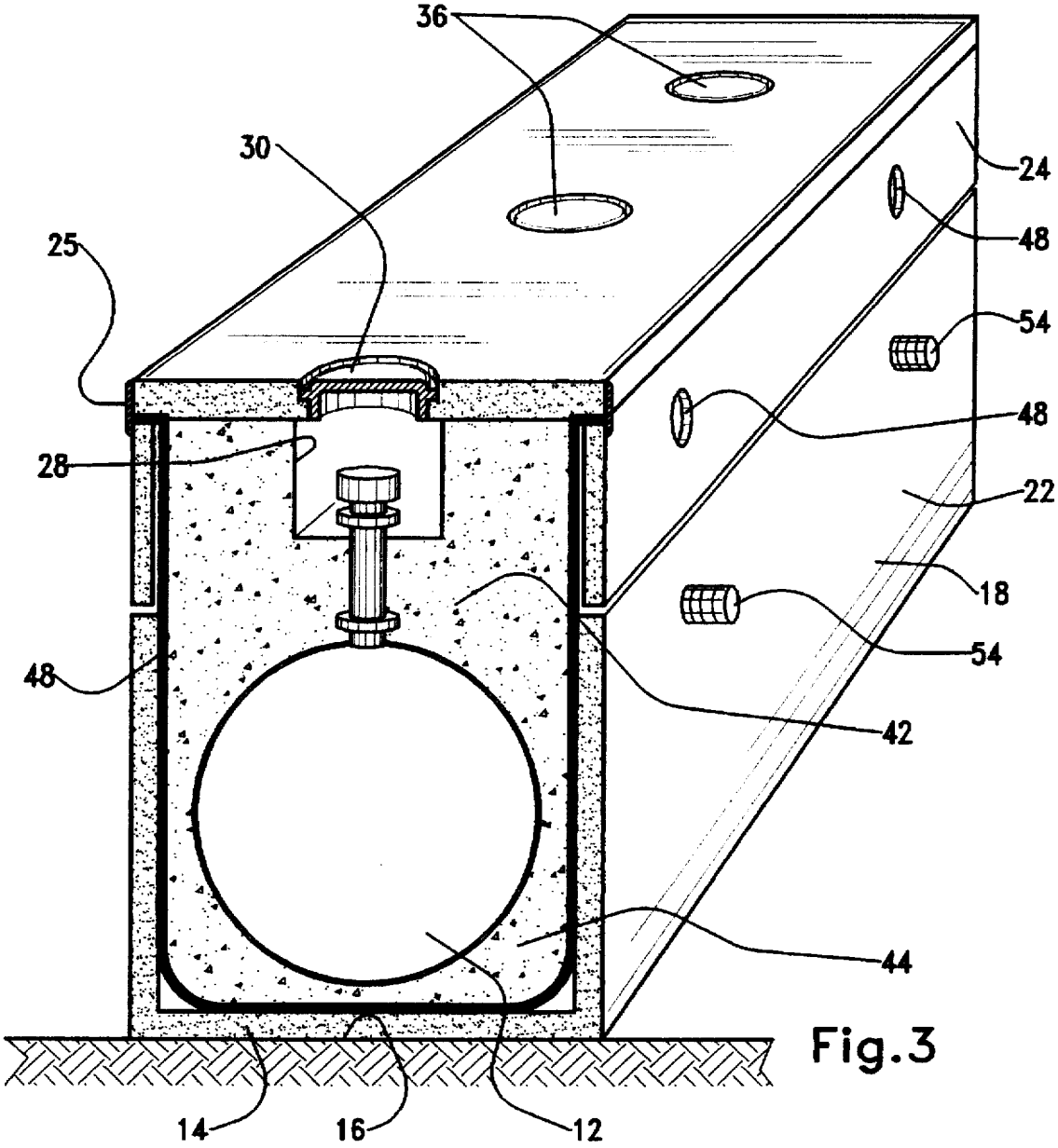
FIG. 3 is a schematic in perspective illustrating details of one module of the battery of FIG. 1.

As may be seen in FIGS. 2A, 2B and 3, each lid 20 includes a series of openings 26 corresponding to respective plastics or rubber buckets 28 fitted onto a pipe 30. Each pipe 30 is joined by a flange 32 to a respective upper opening 34 of the tank 12 and both make up a conduit for loading the tank with fuel. The lid slab 20 doubles as part of the service station floor, such that the installation of the invention does away with having to build one specially once the reservoir 10 has been installed underground.

The openings 26 are covered by sealed lids 36 which block water from seeping in from the floor to the reservoir 10. In any case, the top end of the loading pipes 30 are equipped with a closing lid 38 while the bottom 40 of the bucket 28 is lower than the end 38 of the pipe 30 so that any leak that could happen eventually through the lids 36 of the slab 20 is collected by the the buckets 28 and does not reach the tanks 12 nor the rest of the inside of the container 14. This device is complemented by sensors 39 which detect any accumulation of fluids inside the environment of the container 14 and outside the tank 12 and means for evacuating contaminating fluids by aspiration via a gutter and/or pipings.

Going back to the container 14, the internal surface of the bottom 16 and of the walls 18 is covered by a membrane 40 which is chemically resistant to fuel and/or contaminating products and which may take the form of a layer of plastics or fibre-glass material or else an epoxi resin or fibre-glass cover. This membrane 40 gets to cover at least all of the inside of the lower stage 22, as illustrated in FIGS. 2A and 2B, or, preferably, cover the entire surface of the walls 18, including of the stage 24 of the container 14, up to the level where the lid slab 20 rests.

The inside of each container is filled with binder material 42 between the membrane 40 and the corresponding tank 12, to inmobilize the latter therein. A part of the filler material 42 forms a bed 44 upon which the tank 12 rests, its body fully covered by this material 42 such that there is no contact between the tank 12 and the membrane 40.

Figure 4:
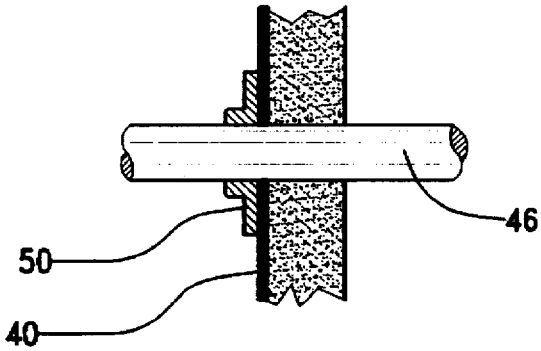
FIG. 4 is an enlarged view of part of FIG. 3 showing in detail in the module a joint in the fuel discharge piping between the tank and the fuel pumps.

The dispenser pumps (not illustrated) of the service station are connected to the reservoir 10 by rigid or flexible piping 46, preferably double-walled. These conduits access the tanks 12 in the containers 14 by means of openings 48 in the upper stage 24 of the side wall 18. As the more detailed FIG. 4 shows, the pipings 46 are connected using hydraulic rubber or PVC seals 50 which preserve the battery isolation 10. The piping 46 is connected to the tank via double joints 52 and may be placed externally thereof in premoulded gutters (not illustrated) or in ducts of a material resistant to the product conveyed through the pipe, acting thus as a double wall.

Going back to the consideration of FIG. 3, the lower stage 22 is provided with a pair of removible bolts 54 affixed to the wall 18 and which carry out two functions. One is to hold the slings when using a crane to lower the lower stage 22 of the container 14 into the hole opened for the reservoir. The other function of the removible bolts 54 is to enable attachment of deadweights (not illustrated) for stabilizing the battery underground, avoiding flotation which may endanger the reservoir structure or the pipings 46. A deadweight system is preferred to the more usually used anchorage system because it is simpler and, mainly, more efficient.

The installation of the battery 10 in the excavation hole is simpler than with known systems known heretofore. Insallation commences with a first module 14 and then with the next module beside the first one and so on. Installation of a module essentially comprises: lowering the lower stage 22 of the container 14 to the bottom of the excavation and then distributing binder material 42 over the bottom 16 of the container 14 to form the bed 44; thereafter the tank 12 is lowered inside the lower stage 22 and rested on the bed 44. The leakage sensors 39 may be installed then, and eventually the piping for aspirating leaked liquids from the bed. More binder 42 is unloaded into the hole until it covers the body of the tank 12 and then the second stage 24 is lowered onto the wall 18 of the first stage 22. Then the the piping 46 for dispensing fuel is placed through the openings 48 of the upper stage 24 and the nooks between piping 46 and opening 48 hermetically sealed. Lastly, the pipes 30 and the buckets 28 are installed and the concrete lid slab 20 is placed on the top of the walls 18 of the upper stage 24.

In above-ground installations, which are sometimes preferred in countryside service station where real-estate is not at a premium, the walls 18 of the container 14 provide an efficient isolation both chemically and structurallywise between the battery of reservoirs 10 and the environment.

Of course, changes, variations and aggregations may be applied to the above-detailed embodiment, without departing from the scope nor the spirit of the invention. The same has been described by way of a preferred embodiment specifically for fuel or gas storage in roadside service stations, however those skilled in the art may suit it to other applications without departing from the purview of the invention as set forth in the appended claims.

I claim:

1. A battery of fluid reservoirs including at least one storage tank arranged inside a module comprising external means for structurally protecting the at least one storage tank and for chemically isolating the fluid contents thereof to protect the environment from eventual fluids leaking from one or more of said tanks; said external means comprising:

a plurality of containers aligned in said modules beside one another, each structurally designed to support the weight of a tank and to contain one of said tanks;

each container including a bottom wall and a lateral wall closing each said container below and around the sides thereof; said bottom wall and said lateral wall each having an inside surface substantially covered by a membrane of a material resistant to said fluid contents;

binder material filling a space between said tank and the bottom wall and the lateral wall of each said container up to a level which at least substantially covers said tank, wherein said tank is substantially spaced laterally and below said membrane by said binder material;

a lid sealing said tank and comprising a slab;

at least one orifice in said lid in fluid communication with a load inlet of the corresponding tank;

at least one opening in said lateral wall for passage of piping for discharging or dispensing said fluid, said opening connected by joining means to the tank; and means for coupling means for lifting and lowering said container extending laterally from said lateral walls.

2. A battery of reservoirs according to claim 1, wherein said containers are aligned in modules beside one another underground.

3. A battery of reservoirs according to claim 1, wherein each of said containers comprises two stages, a first one of which is a bottom stage which includes a container bottom or floor and a part of container side and end walls up to a level of approximately the top of the tank, and a second stage which is an upper stage resting on said lower stage and supporting the lid of the container.

4. A battery of reservoirs according to claim 3, wherein the height of the container is selectable by varying the height of the wall of said upper stage.

5. A battery of reservoirs according to claim 3, wherein said openings for passage of dispensing pipings are formed in side walls of said upper stage.

6. A battery of reservoirs according to claim 3, wherein said coupling means comprises removible bolts projecting perpendicularly from a side wall of said lower stage.

7. A battery of reservoirs according to claim 6, wherein said bolts are attached to deadweights which contribute to stop the container from floating in the surrounding terrain.

8. A battery of reservoirs according to claim 1, wherein said external wall is made of reinforced concrete, alveolar concrete, fibred concrete, centrifugated concrete, fresh steel and/or recycled steel.

9. A battery of reservoirs according to claim 1, wherein said membrane is of fibre-glass, plastics and/or epoxi paint chemically resistant to said fuel contents.

10. A battery of reservoirs according to claim 1, wherein said tanks are of fibre-glass, plastics, steel or one of them recycled.

11. A battery of reservoirs according to claim 1, wherein each tank dispensing piping joint comprises flexible or rigid removible double-walled piping.

12. A battery of reservoirs according to claim 1, wherein each container is provided with means for monitoring fluid leaks.

13. A battery of reservoirs according to claim 1, wherein said fluid is fuel or gasoline and said membrane material is chemically resistant to hydrocarbon products.

14. A battery of reservoirs according to claim 1, wherein said containers are aligned in modules beside one another above ground.

* * * * *